US005518411A

United States Patent [19]

Belleci

[11] Patent Number: 5,518,411

[45] Date of Patent: May 21, 1996

[54] ELECTRICAL PLUG WITH RETRACTABLE PRONG SHIELD

[76] Inventor: Sal J. Belleci, P.O. Box 8184, Pittsburg, Calif. 91565

[21] Appl. No.: 252,412

[22] Filed: Jun. 1, 1994

[51] Int. Cl.[6] ..... H01R 13/44

[52] U.S. Cl. ..... 439/141; 439/140

[58] Field of Search ..... 439/140, 141

[56] References Cited

U.S. PATENT DOCUMENTS

| | | | |
|---|---|---|---|
| 3,210,717 | 10/1965 | Brown | 439/140 OR |
| 3,513,435 | 5/1970 | Degaetano | 439/140 OR |
| 3,575,684 | 4/1971 | McIntyre | 439/140 OR |
| 3,631,320 | 12/1971 | Erkert | 317/9 |
| 3,754,205 | 8/1973 | Lenky . | |
| 3,763,457 | 10/1973 | Whippo . | |
| 4,340,267 | 7/1982 | Nukaga . | |
| 4,391,481 | 7/1983 | Golden . | |
| 4,445,739 | 5/1984 | Wooten . | |
| 4,810,199 | 3/1989 | Kae | 439/141 |
| 5,030,119 | 7/1991 | Lowe | 439/141 |
| 5,167,516 | 12/1992 | Tani et al. | 439/141 |
| 5,252,082 | 10/1993 | Hsieh et al. | 439/141 |

*Primary Examiner*—P. Austin Bradley
*Assistant Examiner*—Daniel Wittels
*Attorney, Agent, or Firm*—Bielen, Peterson & Lampe

[57] ABSTRACT

A safety plug for an electrical cord, the plug having electrically conductive prongs with a pair of protective retractable sheaths of a dielectric material encasing the prongs, with preferably a separate spring biassing each prong to an extended position, the sheaths being retracted on plugging the safety plug into a conventional electrical socket.

5 Claims, 1 Drawing Sheet

ELECTRICAL PLUG WITH RETRACTABLE PRONG SHIELD

BACKGROUND OF THE INVENTION

This invention relates to a safety plug for an electrical cord, particularly where the electrical cord is utilized for electrical devices in a household environment where the plug is plugged into a conventional wall socket.

The safety plug of this invention can be utilized in any environment, but is particularly adapted for use in a household where an electrical plug may become partially dislodged and expose active prong members to children. The safety plug of this invention is designed with a retractable safety shield on each of the two electrically active prongs of the electrical plug. The two safety shields in the form of individual sheaths retract as the prongs are inserted into the socket holes of a conventional electrical socket. In addition to preventing inadvertent contact with partially exposed prongs, the safety shields protect against inadvertent contact with the prongs upon extraction of an electrical plug from a socket. This is particularly important where small children are present. Children, particularly very young children, have a tendency to extract an electrical plug from a wall socket by placing fingers over the end of the partially extracted plug. This can result in a severe shock and burn.

Prior solutions for construction of a safety plug have included accordion-type outer coverings and retractable covers that utilize a shield housing that encompasses both prongs as a unit. The former type of protective means requires an insulator material that will repeatedly collapse in accordion fashion and not crack or lose its shape or resilience. Furthermore, the external accordion type sheath requires extra-long prongs to accommodate for the collapsed shielding material that compiles at the base of the prongs. This can destabilize the seating of the electrical plug and the added length of the prongs provides an additional danger during plugging and unplugging resulting from additional instability in the structure of the plug.

The electrical plugs that have a unitary housing that acts as a shield for simultaneous protection of both prongs customarily includes a spring mechanism located in the body of the plug between the two electrically active prongs. Locating an electrically conductive wire spring between electrically active prong members is somewhat dangerous in the event that the plug becomes damaged and the spring creates an electrical short between the two prong members. Additionally, the use of a single housing for both prongs will cause exposure of a prong when the plug is oriented at an angle where one prong is inserted into the socket at a greater depth than the other prong. In this orientation, the unitary housing is retracted to the insertion point of the more deeply inserted prong allowing a portion of the other prong to be exposed.

Finally, the use of a single shield for both prongs prevents easy visual identification of the location of the two prongs for proper orientation of the plug during insertion of the plug into a socket. These and other problems with the existing safety plugs have made the improved safety plug as disclosed herein a superior design with unique design features not incorporated in prior art devices.

It is a primary object of this invention to provide a safety plug that includes a retractable insulator sheath on each of the two electrical power prongs of an electrical plug. It is a further object of this invention to provide an independent spring bias to each of the two retractable sheaths and to position the biassing spring on the outside of each of the prongs to prevent inadvertent shorting when a metal spring is used.

Finally, it is an object of this invention to include a third prong that is positioned for orientation into the third prong socket in a conventional three prong electrical outlet. This prong assists in stabilizing the plug and engagement of this prong in the socket assists in preventing the shield plug from becoming ejected or withdrawn from the socket as a result of bias from the springs of the retracted sheaths and dislodgement by inadvertent contact of the plug while installed in the socket.

SUMMARY OF THE INVENTION

This invention relates to a safety plug that has a pair of retractable protective sheaths covering the electrically conductive prongs of the plug.

The safety plug of this invention is designed to operate in a conventional household wall socket and can be used with an electrical cord that connects to a light, appliance, motor, or any other type of electrical device.

The primary object of the safety plug is to provide a protective sheath for each of the conducting prongs of the plug such that an individual, particularly a child, does not inadvertently come in contact with exposed prongs of a partially inserted plug. Although the safety plug can be utilized on any type of electrical plug, it is preferred that the plug be permanently installed at the end of a conventional electrical cord for household use. In this manner, the plug is relatively tamper proof and cannot be taken apart by a child. In other environments, the safety plug may be constructed such that it may be taken apart for repair, and with minor modification can be constructed such that the safety plug can be installed on an existing electrical cord as an add-on safety feature.

In the preferred embodiment disclosed, the safety plug has an individual, dielectric sheath that provides a protective shield for each of the two prongs that project from the plug casing. Each sheath is independently retractable when the sheath abuts the outside face of the socket and the prongs insert into the socket slots.

The safety plug of this invention is a substantial improvement over existing devices that include a single retractable housing that covers both prongs. Such a device can be easily disabled by a child who carelessly places his finger over the end of a plug during extraction of the plug. In this manner, both prongs are exposed at once. The two prongs are less likely to be exposed simultaneously when each prong has its own independently actuated sheath. Additionally, the use of an independent sheath for each of the prongs prohibits jamming when the plug is inadvertently twisted or canted while the prongs are inserted into a wall socket. Where a single protective shield protects both prongs simultaneously, jamming of the dual prong shield is more likely to occur, thereby disabling the shield from extending over the prongs when the plug is extracted.

As an additional safety feature in the preferred plug, the compression springs which extend the sheaths such that they encase the prongs, are located internally in the plug casing on the outside of each prong. In this manner, damage to the safety plug and dislodgement of the springs will not create an electrical short between the two prongs.

As an additional feature, a third prong is included at the location of a conventional ground prong. The third prong is utilized as a stabilizer and anchor to prevent the safety plug from being ejected from the socket in the event that the prong sockets are worn. In this manner, the small bias of the retracted sheaths is insufficient to destabilize the installed plug. In addition, the third prong prevents the plug from leaning at an angle which may result in exposure of a portion of one or both of the prongs. The third prong can serve as a conventional ground prong in grounded plug systems.

The use of an independently operated sheath for each electrically conductive prong of the safety plug substantially improves the effectiveness of the plug. With each sheath extended such that the sheaths encase all but the distal ends of the prongs, the orientation of the prongs is still clearly visible. The shielded prongs thereby have the same appearance as ordinary prongs and provide the normal guide to alignment of the prongs with the prong slots of the socket. Additionally, with each prong encased in its own independently operated sheath, if the plug is pushed to one side such that one prong would ordinarily become exposed, the sheath for that prong can extend while the sheath for the installed prong remains retracted. These and other feature will become apparent from a detailed description of the preferred embodiment.

DETAILED DESCRIPTION OF THE PREFERRED EMBODIMENTS

Figure 1:
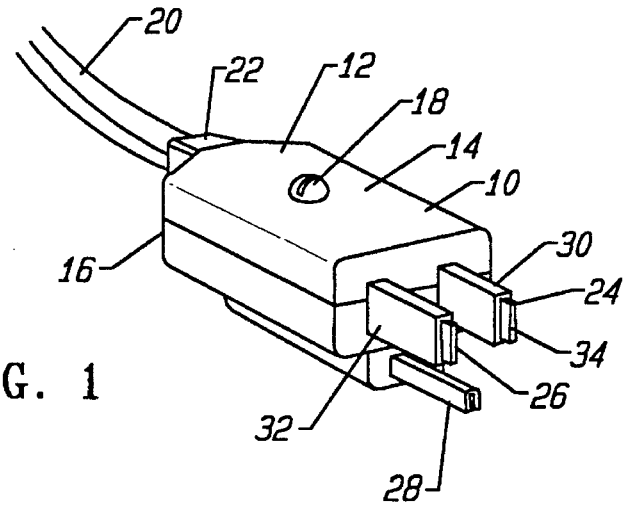
FIG. 1 is a perspective view of the safety plug.

Referring now to FIG. 1, the safety plug, designated generally by the reference numeral 10 is of ordinary appearance with a clam-shell style casing 12 having a top portion 14 and a bottom portion 16 interconnected by a screw 18. A conventional electrical cord 20 extends from a cord guide 22 at one end of the plug casing 12. At the opposite end of the casing 12, is a pair of electrically conductive prongs 24 and 26 which plug into a conventional socket and provide the end terminals for conveying power to the electrical cord 20 for powering an electrical device such as a light, motor, or other electrical appliance. It is to be understood that in certain instances, the cord is not necessary, for example, where the plug is part of the appliance as in a night light or a.c./d.c. transformer. In the preferred embodiment, the safety plug 10 includes a third prong 28 in the form of a round or crescent shaped prong that inserts into the ground socket in a conventional, three-hole electrical outlet.

Figure 2:
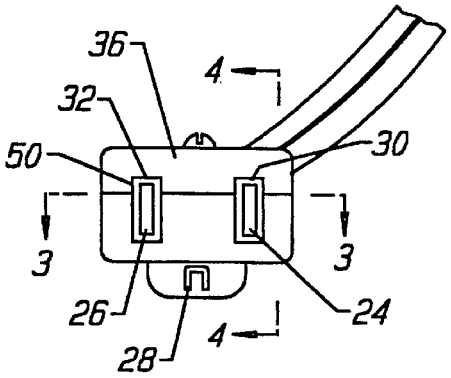
FIG. 2 is an end view of the safety plug of FIG. 1.

The safety plug 10 includes two retractable, dielectric sheaths, 30 and 32, on each of the two conductor prongs, 24 and 26. Each sheath, 30 and 32, comprises a sleeve that individually encompasses its respective prong, 24 and 26, allowing only a short end portion 34 of each prong to be exposed. The end portion 34 is long enough to assist in guiding the prongs 24 and 26 into a socket, but short enough to prevent electrical current to flow while any portion of the prongs are exposed and unprotected by the retractable sheaths. As shown in the end view of FIG. 2, each sheath 30 and 32 encompasses each prong and extends from an end face 36 on the casing 12 of the safety plug 10.

Figure 3:
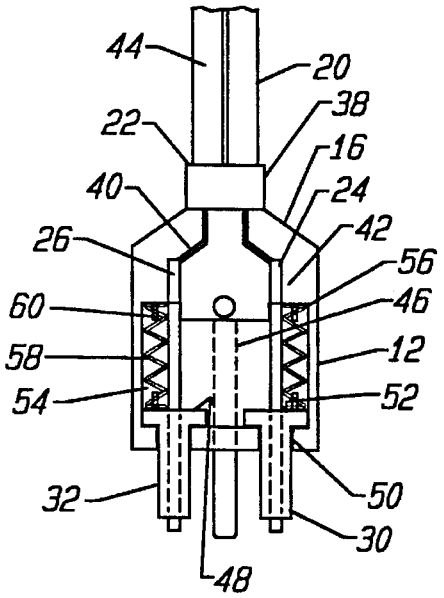
FIG. 3 is a cross sectional view taken on the lines 3—3 in FIG. 2.
Figure 4:
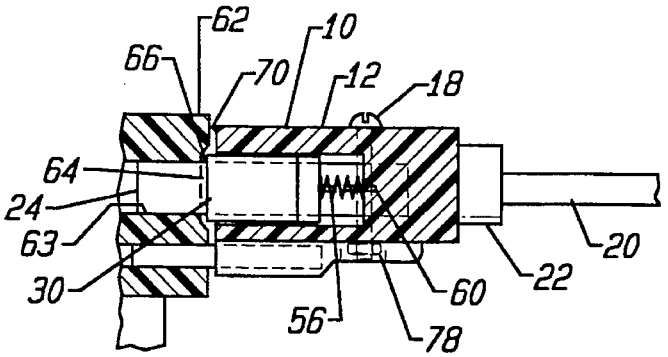
FIG. 4 is a cross sectional view taken on the lines 4—4 in FIG. 2.

Referring now to the cross sectional views of FIGS. 3 and 4, the internal construction of the safety plug can be described. As shown in FIG. 3, the electrical cord 20 has internal conductive wires 38 and 40 which electrically connect to the ends of the elongated prongs 24 and 26, which together with the wires 38 and 40 are embedded in a solid, dielectric base 42 in the bottom portion 16 of the clam-shell casing 12. In this manner, the wires 38 and 40 are anchored by the dielectric base 42 and the outer insulator 44 of the electrical cord 20 is bonded to and anchored by the cord guide 22. The prongs 24 and 26 extend from the base 42 through the end face 36 of the casing 12.

An open compartment 46 in the lower portion 16 of the plug casing 12 allows for retraction of the individual sliding sheaths, 30 and 32. The sheaths, 30 and 32 include a flanged base portion 48 that remains disposed within the compartment 46 of the casing 12. The aperture 50 in the end face 36 is sized and configured to allow free displacement of each sheath, 30 and 32, when retracted or extended as described with reference to FIG. 4. The two parallel prongs 30 and 32 subdivide the internal compartment 46 into two subcompartments, 52 and 54, at the outside of each prong, 30 and 32. In each subcompartment is disposed a compression spring, 56 and 58, with one end in contact with the flanged base portion 48 of the retractable sheath 30 or 32, and the opposite end in contact with the dielectric base 42 in which the prongs are anchored. The compression springs 56 and 58, bias the prong sheaths 30 and 32 into the outwardly extended position as shown in FIG. 3. To insure that the compression springs 56 and 58 remain in position, a small pin 60 is embedded in the plug base 42 and in each flange base portion 48 of the retractable sheaths 30 and 32. The springs 56 and 58 are centered on the pins 60 and retained in position.

Referring now to FIG. 4, the safety plug 10 is shown plugged into a conventional wall socket 62 (shown in part). When the plug 10 is plugged into the socket 62, the prongs (one shown) extend into the socket slot 63 and the sleeve portion 65 of the sheaths are retracted into the casing 12 of the plug 10. The distal end 64 of the sheath contacts the outer wall 66 of the slot 63 allowing only the prong 24 to enter the slot 63 with the wall forcing the sleeve portion 65 of the sheath 30 back into the compartment 46 in the casing 12 against the force of the compressed springs (one shown). Since the slot 63 is customarily recessed from the outer face 70 of the conventional socket, the prongs, 24 and 26, are well protected by the partially extended sheaths, 30 and 32, from any inadvertent contact by an implement or an extremidity of an individual.

As shown in FIG. 4, the clam-shell construction of the plug 10 is secured by a screw 18 and nut 72, and may be permanently secured together by gluing or other bonding means. The third prong 28 can be utilized as a dummy prong for stabilizing the plug in the socket, or, may be connected to a ground wire or internal grounding in the plug as may be preferred for the particular use to which the safety plug is employed. Alternately, the safety plug may be constructed without the third prong 28 with some minor loss in the stability of the plug in a conventional socket, particularly one that has become well worn through use. It is to be understood that the springs that are employed must be adequate to extend the two prong sheaths under less than ideal conditions, for example, when the plug is slightly canted or otherwise misaligned in the socket. However, the spring force must not be so great that the safety plug is ejected by action of the spring, even in a worn socket.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A safety plug for an electrical cord comprising:

a dielectric plug casing having a dielectric base, an internal compartment and an end face;

a pair of first and second electrically conductive prongs having first ends fixedly mounted in the plug casing to the base wherein the prongs are substantially parallel and extend through the end face of the plug casing with distal ends positioned for engagement with an electrical socket;

a pair of first and second retractable sheaths, each sheath substantially encasing a respective prong, each sheath having an end portion positioned in the internal compartment with stop means for retaining at least the end portion in the compartment, and a shield portion extendable from the end face of the plug casing to a position proximate the distal end of the prongs, wherein the sheaths are retractable into the internal compartment exposing the prongs when the plug is plugged into the socket; and, bias means for biassing each prong sheath independently of the other in a direction that extends the sheaths from the end face of the plug, the bias means comprising a separate compression spring associated with each prong, wherein the sheaths are fabricated of a dielectric material and protectively encase the prongs when the plug is partially installed in a socket, wherein the first and second prongs are arranged parallel in a side-by-side arrangement with an inside space between the prongs and an outside space between each prong and the plug casing wherein the compression springs are each positioned in their entirety in a respective outside space between the prong and the casing.

2. An electrical plug comprising:

a plug housing having an end face with a pair of projecting, electrically conducting prongs, wherein each prong has a retractable, dielectric sheath, each sheath substantially encasing each prong wherein the sheaths are retracted into the housing when the plug is inserted into a conventional electrical socket; and, bias means for biassing the sheath against retraction into the plug housing, wherein each sheath is biassed to extend over the prong and, wherein the bias means comprises a compression spring, each sheath having a separate compression spring for independent bias of each sheath wherein the housing has an internal compartment and a dielectric base opposite the end face, the prongs being anchored in the base and projecting through the end face, wherein the sheaths have a base portion located in the compartment and a sleeve portion arranged around each prong and extendable through the end face, the compression spring being arranged in the compartment with a first end in engagement with the housing base and a second end in engagement with the base portion of the sheaths wherein the prongs are substantially parallel and have a portion of the prong in the housing between the base and the end face that divides the housing compartment into subcompartments including an inner subcompartment between the prong portions, and a pair of outer subcompartments outside the prongs between the prongs and the housing wherein the two compression springs are located in their entirety in respective outer subcompartments.

3. The electrical plug of claim 2 wherein the end face of the plug has an aperture around each prong, and each sheath projects through each respective aperture.

4. The electrical plug of claim 3 wherein the base portion of a stop limiting extension of the sheaths through the end face.

5. The electrical plug of claim 2 wherein the plug includes a third prong projecting through the end face, the third prong engageable with the ground socket in a conventional three-hole electrical outlet.

* * * * *